United States Patent [19]

Goolkate

[11] 4,334,936

[45] Jun. 15, 1982

[54] LIQUID COMPOSITION FOR PHOSPHATING METAL SURFACES

[75] Inventor: Jannes J. Goolkate, Enschede, Netherlands

[73] Assignee: Akzo N.V., Arnhem, Netherlands

[21] Appl. No.: 234,401

[22] Filed: Feb. 13, 1981

[30] Foreign Application Priority Data

Feb. 14, 1980 [NL] Netherlands ..... 8000916

[51] Int. Cl.[3] ..... C23F 7/08

[52] U.S. Cl. ..... 148/6.15 R

[58] Field of Search ..... 148/6.15 R, 6.2

[56] References Cited

U.S. PATENT DOCUMENTS 2,986,482 5/1961 Sharp ..... 148/6.15 R 4,008,101 2/1977 Rowe et al. ..... 148/6.15 R

FOREIGN PATENT DOCUMENTS 895275 5/1962 United Kingdom .

*Primary Examiner*—Ralph S. Kendall

*Attorney, Agent, or Firm*—Stevens, Davis, Miller & Mosher

[57] ABSTRACT

A liquid composition for phosphating metal surfaces is disclosed which composition contains a major amount of methylene chloride, a phosphating proportion of phosphoric acid, water in an amount exceeding the proportion of phosphoric acid, an aliphatic solvent which has an alcohol function, contains less than six carbon atoms and is present in an amount sufficiently high for the phosphoric acid and water in the methylene chloride to be solubilized to a homogeneous, liquid phase, and an agent for improving the structure of the phosphate coating, characterized in that said agent is a surface active substance of the anionic or amphoteric type. The surface active substance is employed in the amount of about 0.01 to 1% by weight.

13 Claims, No Drawings

LIQUID COMPOSITION FOR PHOSPHATING METAL SURFACES

This invention relates to a liquid composition for phosphating metal surfaces, which composition contains (a) a major amount of methylene chloride, (b) a phosphating proportion of phosphoric acid, (c) water in an amount exceeding the proportion of phosphoric acid, (d) an aliphatic solvent which has an alcohol function, contains less than six carbon atoms and is present in an amount sufficiently high for the phosphoric acid and water in the methylene chloride to be solubilized to a homogeneous, liquid phase, and (e) an agent for improving the structure of the phosphate coating.

A composition of the type indicated above is known from British Pat. No. 1,548,731. As a means of improving the structure of the phosphate coating this known composition contains an aprotic, polar organic compound. The content of aprotic compound is on the average 3 to 4% by weight, dimethyl formamide being recommended as a particularly suitable compound.

Although dimethyl formamide undoubtedly has a favorable effect on the structure of the coating, there is a definite need for other means having a similar effect but offering wider technical scope and adaptability. There is a particular need for agents that are effectively used in a lower concentration and of which less or nothing is lost via the vapor phase in the phosphating process.

The present invention provides such improved agents.

According to this invention, the present liquid composition is characterized in that said agent is a surface active substance of the anionic or amphoteric type.

It should be noted that the use of an anionic surface active agent in a phosphating composition is mentioned in U.S. Pat. No. 2,986,482. In that case, however, it is employed in combination with a sorbitan ester of a fatty acid for an anhydrous composition based on trichloroethylene, perchloroethylene, and methyl chloroform.

As far as the basic components of the composition according to the present invention are concerned, viz. methylene chloride, phosphoric acid, water and the solubilizing agent, general reference may be made to the British patent cited above.

In relation to all the other components, methylene chloride is present in a predominant amount and as a rule amounts to more than 50% by weight of the composition. It is preferred that the composition contains about 55% to 85% by weight of methylene chloride. Considering the requirement that the composition should have a homogeneous liquid phase, the methylene chloride content within the above range can be adjusted easily with regard to the amounts of phosphoric acid and water and the choice of the solubilizing agent.

The phosphoric acid should be present in an amount sufficiently high to effect the phosphating envisaged. The amount to be used can be rather small, and may be as little as, for instance, about 0.05% by weight. In principle it is also possible to employ amounts of 2% by weight or more, although both solubilization and the quality of the resulting coating may then become less satisfactory. For practical purposes the most suitable phosphoric acid content ranges as a rule from about 0.1 to 1% by weight.

The presence of water in an amount higher than that of the phosphoric acid is primarily intended to provide a coating which is practically insoluble in water. For that reason the composition may have a water content of 20% by weight or higher. Such high proportions, however, are not necessary; nor are they advisable because of the chance of phase separation in the liquid phase. Therefore, and also in view of the choice of the solubilizing agent, the water content used in actual practice will generally be between about 1 to 10% by weight, and preferably in the range of from 2 to 5% by weight.

Finally, the solubilizing agent is an aliphatic solvent which has an alcohol function and less than six carbon atoms, the amount in which it is used being primarily governed by solubilization capacity. Examples of suitable solvents of the type envisaged include: methanol, ethanol, propanol, allyl alcohol, butanol and isomers thereof. Also suitable are derivatives of these alcohols, such as 2-butoxy ethanol, provided that the alcohol function is retained.

As a rule the solubilization capacity decreases with the number of carbon atoms. Further, the amount of a particular solvent should be higher as the composition contains more phosphoric acid and water. Generally, an amount of about 10 to 50% by weight of solvent will suffice for the remaining components to solubilize to a homogeneous liquid phase. Preference is given to the use of methanol because of its solvent power and other practical properties. A content in the order of 15 to 25% by weight of methanol generally results in obtaining favorable compositions.

According to the present invention a surfactant of the anionic or amphoteric type is incorporated in the compositions comprising the four above-mentioned basic components.

Improvement of the phosphate coating has already been observed as a result of the use of said surfactant in small amounts of from, say, about 0.01% by weight. In principle the improvement gains with increasing amount of said substance up to a content of as high as about 1% by weight. Higher percentages generally offer little or no further advantage and are even inadvisable in that they may lead to a turbid composition. Apart from the differences in effectiveness of the various individual surfactants of the above type, an optimum effect is usually obtained with a content in the range of from 0.05 to 0.5% by weight.

Of the anionic surfactants especially effective are those of the carboxylic acid-salt type. Examples thereof include the amine salts of polyether carboxylic acids, sodium salts of succinic acid derivatives and sodium salts of N-substituted amino acids. Also very suitable are anionic surfactants of the sulphuric acid-ester type. As examples thereof may be mentioned: sodium alkyl ether sulphates, sodium aryl ether sulphates and triethanol ammonium alkyl sulphates. Other anionic surfactants that have an appreciably favorable effect are, for example, of the sulphonate or the phosphoric acid-ester type.

Of the amphoteric surfactants especially those should be mentioned that are of the substituted betaine type and substituted amino acids. Representative examples include dimethyl-carboxymethyl-acylamidoethyl-hydroxyethyl-amino acetic acid and alkyl-aminobutyric acid.

To the liquid composition according to the present invention, there may with advantage be added an organic accelerator compound. The use of such a compound is also mentioned in the British patent already cited and so need hardly be further described. As examples of suitable organic accelerator compounds may be mentioned: dinitrotoluene, urea and thiourea, which may generally be used in an amount of as little as about 0.05 to 0.1% by weight.

It is usual in the art for chlorinated hydrocarbons to be protected against oxidative decomposition by the use of a suitable stabilizer. The presence of such an agent is, of course, also of advantage here. In the case of methylene chloride use may be made of, for instance, aliphatic amines, such as t-butylamine, substituted phenols, epoxy alkanes, aliphatic esters such as methyl acetate, hydrocarbons such as cyclohexane, and the like.

The useful effects obtained with the liquid compositions according to the present invention are further illustrated in the following examples:

EXAMPLE I

A series of tests was carried out starting from a basic composition made up of 78.6% by weight of methylene chloride, 16.8% by weight of methanol, 0.5% by weight of phosphoric acid (85%), and 3.9% by weight of water, to which 0.06% by weight of dinitrotoluene was added as accelerator.

To portions of this basic composition there were added different surface active substances according to the present invention up to a content ranging from 0.06 to 0.4% by weight.

The resulting different liquid portions were subsequently used for phosphating degreased steel test panels (steel 37) by immersing the panels for 2 minutes at about 40° C. in the boiling liquid. Next, the panels were rinsed with methylene chloride (containing 5% by weight of methanol and 0.5% by weight of water) and dried in the vapor zone above the phosphating liquid. The quality of the resulting phosphate coating was evaluated visually and on the basis of photomicrographs obtained by the known S.E.M. technique (Scanning Electron Microscopy).

The test results are summarized in Table A. This table gives the various surfactants added, the amounts in which they were used, and the quality of the coating indicated by crosses. The quality ranges from just about serviceable (1 cross) to excellent (5 crosses).

The substances that were added in the successive tests are listed below by their various trade names and by the respective firms from which they were obtained.

1. "Akypo RLM45M", Chem-Y
2. "Steinapol SBL203-G", Rewo
3. "B3010", Rewo
4. "Arkomon A", Hoechst
5. "Steinapol NL3", Rewo
6. "Steinaryl TKS90/F", Rewo
7. "Steinaphat NP90", Rewo
8. "Steinapol NOS25", Rewo
9. "Steinapol TLS40", Rewo
10. "Steinaryl NKS100", Rewo
11. "Steinaphat EAK8190", Rewo
12. "Steinapon AMB13", Rewo
13. "Steinapon AM2L", Rewo
14. "Armeen Z", Akzo Chemie

TABLE A

| Test No. | Substance Added | wt. % | rating |
|---|---|---|---|
| 1 | (lauryl-myristyl) alcohol polyglycolethercarboxylic acid monoethanolamine salt | 0.12 | xxxxx |

TABLE A-continued

| Test No. | Substance Added | wt. % | rating |
|---|---|---|---|
| 2 | disodium lauric acid amido-ethyl sulphosuccinate | 0.08 | xxxxx |
| 3 | disodium dodecenyl succinate | 0.10 | xxxx |
| 4 | sodium N-oleyl N-methylglycine | 0.12 | xxxx |
| 5 | sodium laurylpolyglycolether sulphate | 0.25 | xxxx |
| 6 | trimethyl ammonium dodecyl-benzene sulphonate | 0.08 | xxx |
| 7 | nonylphenolpolyglycolether phosphate | 0.07 | xxx |
| 8 | sodium nonylphenolpolyglycol-ether sulphate | 0.40 | xx |
| 9 | triethanolammonium lauryl sulphate | 0.16 | x |
| 10 | sodium p-dodecylbenzene sulphate | 0.06 | x |
| 11 | lauryl alcohol polyglycolether phosphoric acid-ester | 0.06 | x |
| 12 | dimethyl-carboxymethyl-coco-amidopropyl ammonium betaine | 0.19 | xxxxx |
| 13 | N-hydroxyethyl-N-Na carboxy-methyl lauric acid amido-ethylamine | 0.14 | xxxxx |
| 14 | N-coco-β-aminobutyric acid | 0.12 | x |
| 15 | none | — | poor |

Table A shows that as compared with the control (Test No. 15) all anionic (Tests 1-11) and amphoteric (Tests 12-14) substances added led to an improvement in quality of the coating. Excellent results were obtained with the substances used in Tests 1-5 and 12-13.

For further comparison a test was carried out on a portion of the basic composition comprising in all 3% by weight of dimethyl formamide, in accordance with a prior art method (British Pat. No. 1,548,731). The quality obtained was approximately of the level of the result of Test No. 5.

EXAMPLE II

This example shows the use of other alcohol solvents. The compositions to be tested contained the surfactant of Test No. 3 and as solvent they comprised n-propanol and secondary butanol, respectively, instead of methanol.

With all other components being used in the same amounts as in Example I, the weight ratio alcohol/-methylene chloride had to be increased in order to maintain a homogeneous composition.

Test data including the visually evaluated results are listed in Table B.

TABLE B

| Test No. | Substance added | wt. % | rating |
|---|---|---|---|
| 16 | n-propanol | 27 | xx |
| | methylene chloride reduced to | 68.3 | |
| 17 | sec. butanol | 38.5 | x |
| | methylene chloride reduced to | 56.8 | |

EXAMPLE III

Several tests were carried out to determine the effect of the accelerator in combination or not with the surfactant with respect to the basic composition. The basic composition of Example I was tested without accelerator (dinitrotoluene), again without accelerator and with the surfactant of Test No. 3, and in the presence of both this surfactant and, successively, two different accelerators.

The quality of the resulting coatings was evaluated on the basis of S.E.M. photomicrographs. The results of these tests are summarized in Table C, with the quality being indicated by crosses, as in Table A.

TABLE C

| Test No. | Substance added | wt % | rating |
|---|---|---|---|
| 18 | none | — | poor |
| 19 | substance of Test No. 3 | 0.1 | xx |
| 20 | substance of Test No. 3 + urea | 0.1 | xxxxx |
| 21 | substance of Test No. 3 + thiorea | 0.1 | xx |

From the results of these tests and the preceding tests it is apparent that whereas leaving out the surfactant leads to unacceptable results (tests 15 and 18), leaving out the accelerator (test 19) is not quite prohibitive. According to the tests 3, 20 and 21, however, the presence of an accelerator does appear to be advisable.

I claim:

1. A liquid composition for phosphating metal surfaces, which composition contains a major amount of methylene chloride, a phosphating proportion of phosphoric acid, water in an amount exceeding the proportion of phosphoric acid, an aliphatic solvent which has an alcohol function, contains less than six carbon atoms and is present in an amount sufficiently high for the phosphoric acid and water in the methylene chloride to be solubilized to a homogeneous, liquid phase, and a minor amount of an agent sufficient for improving the structure of the phosphate coating, characterized in that said agent is a surface active substance of the anionic or amphoteric type.

2. A composition according to claim 1, characterized in that the surface active agent is of the anionic carboxylic acid-salt type.

3. A composition according to claim 2, characterized in that the surface active agent is a salt of ethanolamine and a fatty alcohol polyglycolethercarboxylic acid.

4. A composition according to claim 2, characterized in that the surface active agent is a derivative of succinic acid.

5. A composition according to claim 4, characterized in that the derivative is disodium lauric acid amido ethylsulphosuccinate.

6. A composition according to claim 4, characterized in that the derivative is disodium dodecenylsuccinate.

7. A composition according to claim 2, characterized in that the surface active agent is sodium-N-oleyl N-methylglycine.

8. A composition according to claim 1, characterized in that the surface active agent is of the anionic sulphuric acid-ester type.

9. A composition according to claim 8, characterized in that the surface active agent is sodiumlauryl polyglycol ether sulphate.

10. A composition according to claim 1, characterized in that the surface active agent is of the amphoteric betaine type.

11. A composition according to claim 10, characterized in that the surface active agent is dimethylcarboxymethyl coco-fatty acid amido-propylammonium betaine.

12. A composition according to claim 1, characterized in that the surface active agent is the amphoteric sodium salt of an N-hydroxyethyl N-carboxymethyl fatty acid amido-ethylamine.

13. A composition according to any one of the preceeding claims, characterized in that the surface active agent is contained in it in an amount of about 0.01 to 1% by weight.

* * * * *